US009914559B2

(12) United States Patent
Sasaki

(10) Patent No.: US 9,914,559 B2
(45) Date of Patent: Mar. 13, 2018

(54) GUARD FOR A COMPRESSED AIR TANK

(71) Applicant: Advanced Air Systems, Inc., Lodi, CA (US)

(72) Inventor: Steve Sasaki, Lodi, CA (US)

(73) Assignee: Advanced Air Systems, Inc., Lodi, CA (US)

( * ) Notice: Subject to any disclaimer, the term of this patent is extended or adjusted under 35 U.S.C. 154(b) by 63 days.

(21) Appl. No.: 15/176,278

(22) Filed: Jun. 8, 2016

(65) Prior Publication Data

US 2017/0275052 A1 Sep. 28, 2017

Related U.S. Application Data

(60) Provisional application No. 62/312,394, filed on Mar. 23, 2016.

(51) Int. Cl.
*B65D 25/28* (2006.01)
*F17C 13/00* (2006.01)

(52) U.S. Cl.
CPC ..... *B65D 25/2802* (2013.01); *F17C 13/00* (2013.01)

(58) Field of Classification Search
CPC ..... B65D 25/2802; F17C 13/00
USPC ..... 220/724, 725, 726, 727
See application file for complete search history.

(56) References Cited

U.S. PATENT DOCUMENTS 5,845,830 A * 12/1998 Dreiling ..... B62J 1/16 224/412

* cited by examiner

*Primary Examiner* — Stephen Castellano
(74) *Attorney, Agent, or Firm* — Temmerman Law Office; Mathew J. Temmerman

(57) ABSTRACT

A detachable handle includes a substantially U-shaped structural member and a second attaching member. A proximal end of the structural member includes a first attaching member and a distal end includes a plurality of clip members and at least one hole to hold a plurality of connection fittings and couplers respectively. A central opening is formed to hold at least one valve assembly when the second attaching member is connected to the first attaching member using at least one fastening member. The detachable handle is designed to keep the plurality of connection fittings and the at least one valve assembly away from the ground and out of the dirt.

2 Claims, 3 Drawing Sheets

GUARD FOR A COMPRESSED AIR TANK

RELATED APPLICATIONS

This application claims priority from the U.S. provisional application having Ser. No. 62/312,394, filed Mar. 23, 2016. The disclosure of that provisional application is incorporated herein by reference as if set out in full.

BACKGROUND OF THE DISCLOSURE

Technical Field of the Disclosure

The present embodiment relates in general to handles for compressed air tanks. More specifically, the present disclosure relates to an improved, detachable handle assembly attached to the top of the compressed air tank to hold air compressor connection fittings.

Description of the Related Art

In manufacturing operations, compressed air is utilized to perform many necessary operations such as powering air tools, sprayers, and inflating tires. In portable applications, the accessories for the compressed air tank such as hoses for power tools driven by the compressor, and/or other suitable construction materials may need to be transported to a job site. It is envisioned that the air compressor assembly handle may be modified to accommodate transportation of these types of items.

Conventional compressed air tanks are often heavy, bulky, and difficult to handle. Often, operators must grasp the valve that extends from the top of the tank to move it. This is unsuitable because the valve can be an insecure grip for the operator's hand.

Current models of portable air compressor tanks comprise a handle or supporting structure to conveniently lift and transport the tank. However current handles for air compressor tanks are not suited for operators who use a variety of connection fittings for various air hoses. When an operator places the air compressor on the ground, the connection fittings and other hoses attached to the air compressor can become dirty. Also time is often wasted by an operator trying to locate specific air compressor connection fittings at the time of usage, which makes it inconvenient and less efficient for the operators. These conventional handle assemblies fail to provide the means to hold additional hoses.

Therefore, there is a need for a detachable handle that would attach to the top of a compressed air tank and hold the connection fittings for compressed air hoses. Such a needed handle would include supporting members to hold hoses and an air tool to keep these connection fittings off the ground and out of the dirt. Further, such a handle would include at least one supporting member that may be sized to accept a coupler standard for most air tools. The present embodiment overcomes the existing shortcomings in this area by accomplishing these objectives.

SUMMARY OF THE DISCLOSURE

The present embodiment is a detachable handle connected to the top of a compressed air tank having clips to hold hoses and at least one hole to hold couplers for an air tool, so as to keep the connection fittings off the ground and out of the dirt. The detachable handle comprises a substantially U-shaped structural member having a proximal end and a distal end. The proximal end has a first attaching member with a left aperture and a right aperture. A second attaching member comprises a left orifice and a right orifice. The left orifice and right orifice are aligned with left aperture and right aperture respectively and thereby define a central opening for holding at least one valve assembly. The distal end has a plurality of clip members and at least one hole. The clip members are used to hold a plurality of connection fittings and the at least one hole is used to hold couplers.

A first objective of the present invention is to provide a plurality of clip members to hold the plurality of connection fittings.

A second objective of the present invention is to provide a plurality of clip members in the detachable handle so as to keep the connection fittings off a ground surface.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 1:
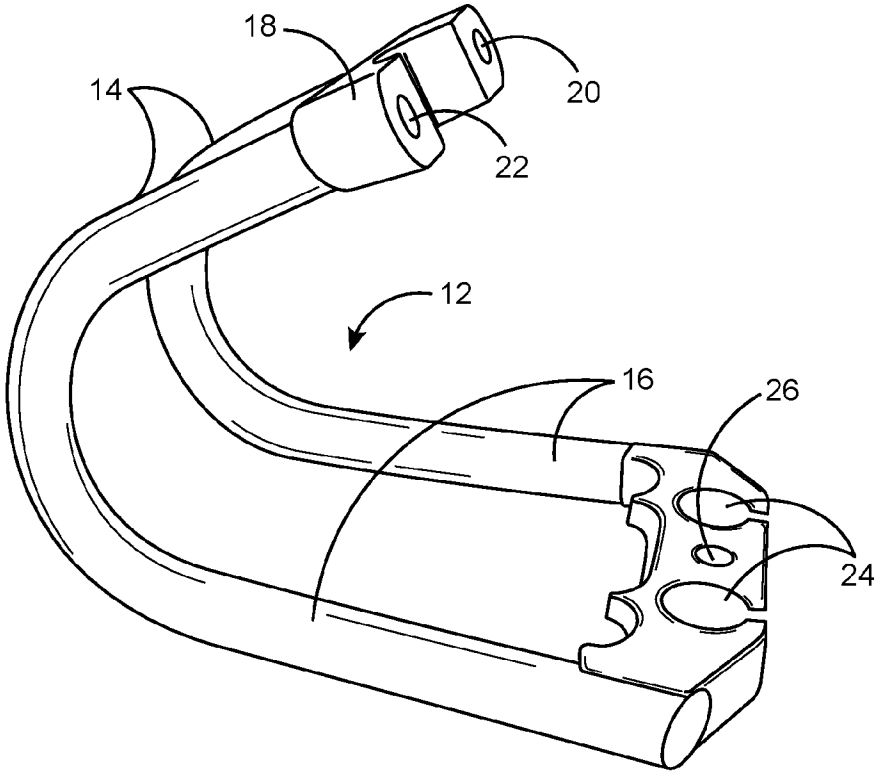
FIG. 1 illustrates a front perspective view of a substantially U-shaped structural member of a detachable handle in accordance with a preferred embodiment of the present invention.

Turning first to FIG. 1, a front perspective view of a substantially U-shaped structural member 12 of a detachable handle 10 (See FIG. 2) in accordance with a preferred embodiment of the present invention is illustrated. The detachable handle 10 comprises the substantially U-shaped structural member 12 having a proximal end 14 and a distal end 16. The proximal end includes a first attaching member 18 with a left aperture 20 and a right aperture 22. The distal end 16 includes a plurality of clip members 24 and at least one hole 26 to hold a plurality of connection fittings and couplers respectively.

Figure 2:
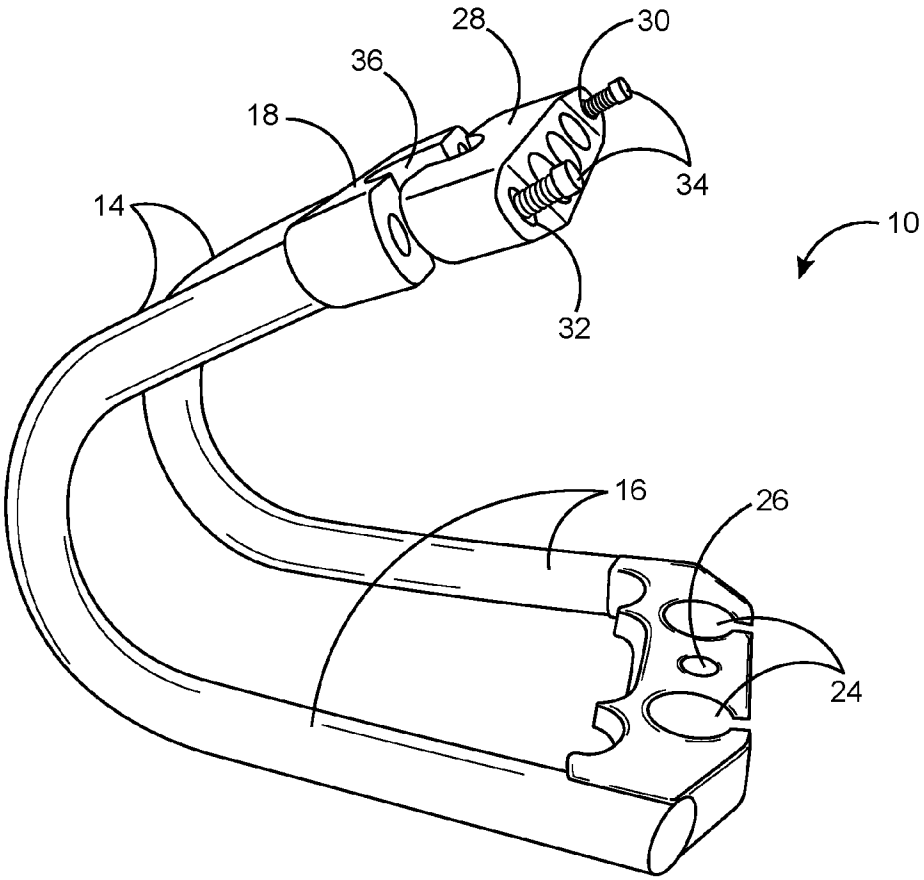
FIG. 2 illustrates a top perspective view of a detachable handle in accordance with a preferred embodiment of the present invention.

FIG. 2 illustrates a top perspective view of a detachable handle 10 that shows the connection of a second attaching member 28 to the first attaching member 18 in accordance with the preferred embodiment of the present invention. A second attaching member 28 having a left orifice 30 and a right orifice 32, the left 30 and right orifices 32 is aligned with the left 20 (See FIG. 1) and right apertures 22 (See FIG. 1) and connecting the second attaching member 28 to the first attaching member 18 using a pair of fastening member 34 thereby defining a central opening 36 for holding at least one valve assembly 38 (See FIG. 3). The left orifice 30 and the right orifice 32 of the second attaching member 28 are at ends and three dips are at the middle for aesthetic look.

Figure 3:
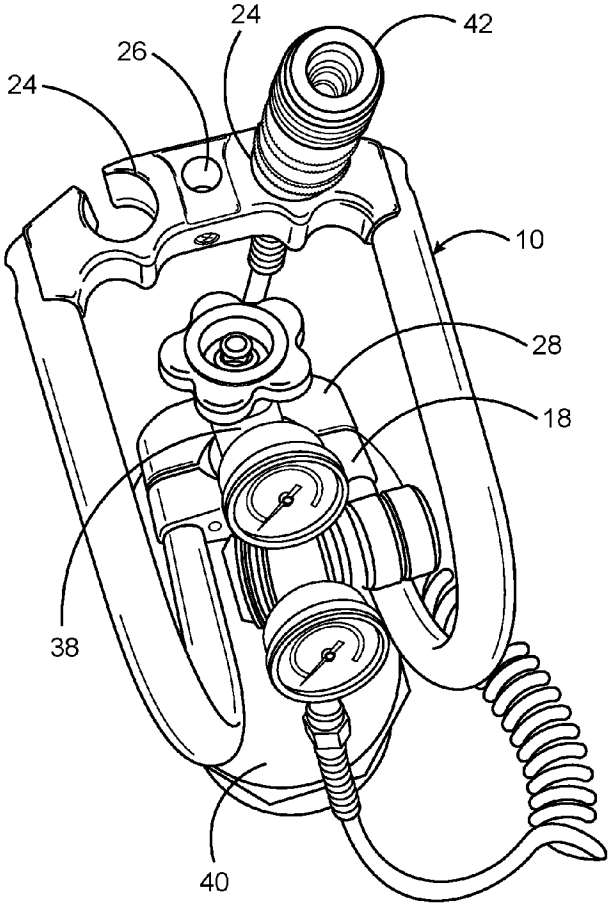
FIG. 3 illustrates an implementation of detachable handle to a compressed air tank when in use.

FIG. 3 illustrates an implementation of the detachable handle 10 to a compressed air tank 40 when in use. The detachable handle 10 attached to the compressed air tank 40 comprising the substantially U-shaped structural member 12 (See FIG. 1) having the proximal end 14 (See FIG. 1) and the distal end 16 (See FIG. 1), the proximal end 14 having the first attaching member 18 with the left aperture 20 (See FIG. 1) and the right aperture 22 (See FIG. 1), the distal end 16 having a plurality of clip members 24 and at least one hole 26 to hold a hose 42 and couplers of the compressed air tank 40 respectively. The second attaching member 28 having the left orifice 30 (See FIG. 2) and the right orifice 32 (See FIG. 2), the left 30 and right orifices 32 is aligned with the left 20 and right apertures 22 and connecting the second attaching member 28 to the first attaching member 18 using through a pair of fastening member 34 (See FIG. 2) thereby defining the central opening 36 for holding the at least one valve assembly 38 of the compressed air tank 40. The clip members 24 have slits to adapt the connection fittings. The clip members 24 and the at least one hole 26 holds hose 42 and an air tool respectively to keep the connection fittings of the hose 42 off the ground and out of the dirt. The at least one hole 26 is sized to accept a quarter inch industrial coupler, standard for most air tools.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A detachable handle attached to a compressed air tank, the detachable handle comprising:

a substantially U-shaped structural member having a proximal end and a distal end, the proximal end having a first attaching member with a left aperture and a right aperture, the distal end having a plurality of clip members and at least one aperture to hold a plurality of connection fittings and couplers of the compressed air tank respectively; and a second attaching member having a left orifice and a right orifice, the left and right orifices being aligned with the left and right apertures and connecting the second attaching member to the first attaching member using at least one fastening member thereby defining a central opening for holding at least one valve assembly of the compressed air tank.

2. The detachable handle of claim 1 wherein the at least one fastening member is selected from a group consisting of bolts, screws, and other fasteners.

* * * * *